US005114069A

United States Patent [19]

Detzel et al.

[11] Patent Number: 5,114,069

[45] Date of Patent: May 19, 1992

[54] PACK

[75] Inventors: Josef Detzel, Kempten; Jurgen Matzel, Hamburg; Rüdolf Kraüs, Osterreinen; Dieter Peissl, Mannheim, all of Fed. Rep. of Germany

[73] Assignee: Lever Brothers Company, Division of Conopco, Inc., New York, N.Y.

[21] Appl. No.: 676,134

[22] Filed: Mar. 27, 1991

[30] Foreign Application Priority Data

Mar. 29, 1990 [DE] Fed. Rep. of Germany ..... 4010056

[51] Int. Cl.[5] ..... B65D 5/40

[52] U.S. Cl. ..... 229/125.15; 220/462; 220/441

[58] Field of Search ..... 229/125.15, 132; 220/460, 461, 403, 462, 441

[56] References Cited

U.S. PATENT DOCUMENTS

| | | | |
|---|---|---|---|
| 3,173,579 | 3/1965 | Curie et al. | 220/460 |
| 3,233,817 | 2/1966 | Casady | 220/441 |
| 3,306,514 | 2/1967 | MacKendrick | 206/621.3 |
| 3,952,940 | 4/1976 | Malcolm | 220/462 |
| 4,572,422 | 2/1986 | Heuberger et al. | 220/462 |
| 4,971,243 | 11/1990 | Lisiecki | 229/125.15 |
| 5,048,691 | 9/1991 | Heuberger et al. | 220/403 |

*Primary Examiner*—Stephen Marcus
*Assistant Examiner*—Christopher McDonald
*Attorney, Agent, or Firm*—Ronald A. Koatz

[57] ABSTRACT

Pack made from board or a similar material with two side panels, two end panels, a base formed from four flaps and a lid also formed from four flaps, as well as with an opening located at the top end of an end panel for removing free-flowing products. At least one of the lid flaps hinged to the side panels does not extend all the way to the end panel incorporating the removal opening and the top section of this end panel, in which the removal opening is located, is folded back until it rests against this lid flap.

1 Claim, 6 Drawing Sheets

PACK

The invention relates to a pack made from board or a similar material with two side panels, two end panels, a base formed from four flaps and a lid also formed from four flaps, as well as with an opening located at the top end of an end panel for removing free-flowing products.

DE-PS 33 36 269 discloses such a pack, where the top end of an end panel can be folded in so that a pouring element provided there is protected and at the same time a more favourable pouring shape is created. To make this folding operation possible, the two side panels are each provided with two oblique folding lines, along which the side panels are folded inwards. The disadvantage of this is, however, that this folded construction is not very stable.

The purpose of the invention is to create a pack of the kind outlined above which protects the opening reliably, is easy to handle and is very stable.

In the solution to this problem proposed by the invention, at least one of the lid flaps hinged to the side panels does not extend all the way to the end panel incorporating the removal opening and the top section of this end panel, in which the removal opening is located, is folded back until it rests against this lid flap.

In a further embodiment of the invention the top section of the end panel incorporating the removal opening is divided off from this end panel by a horizontal folding line and two folding lines located at an acute angle to the folding line between the adjacent side panel and this end panel extend from the two ends of the horizontal folding line, one of them on the end panel and the other on the side panel.

It is also very advantage if in accordance with the invention the folding lines on the end panel are at least slightly curved where they start from the horizontal folding line.

In a further development of the invention, two curved folding lines are provided in the top section of the end panel, which start at the same level from the folding lines between the end panel and the two adjacent side panels and extend to the top end of the end panel.

It is also very advantageous if in accordance with the invention additional folding lines are provided on both end panels.

In a further development of the invention that is particularly advantageous when an inner bag is being used, cut-out sections with a preferably semi-circular shape are provided at least in the flaps hinged to the two side panels to form the base.

The pack can be handled particularly effectively if it is designed in such a way in accordance with the invention that the two flaps hinged to the side panels to form the lid are narrower at the end facing the end panel provided with additional folding lines than they are at the end facing the other end panel.

Material consumption can then be cut particularly effectively if in accordance with the invention the two flaps hinged to the other end of the side panels to form the base run similarly obliquely to the lid flaps, but the other way round.

It has proved to be particularly effective for pack erection if in accordance with the invention a dust flap, which is essentially as wide as the distance between the additional folding lines and has a lateral projection which defines the width of the lid at this point, is hinged to the top end panel provided with the additional folding lines.

Several embodiments of the invention are illustrated in the drawings.

Figure 1:
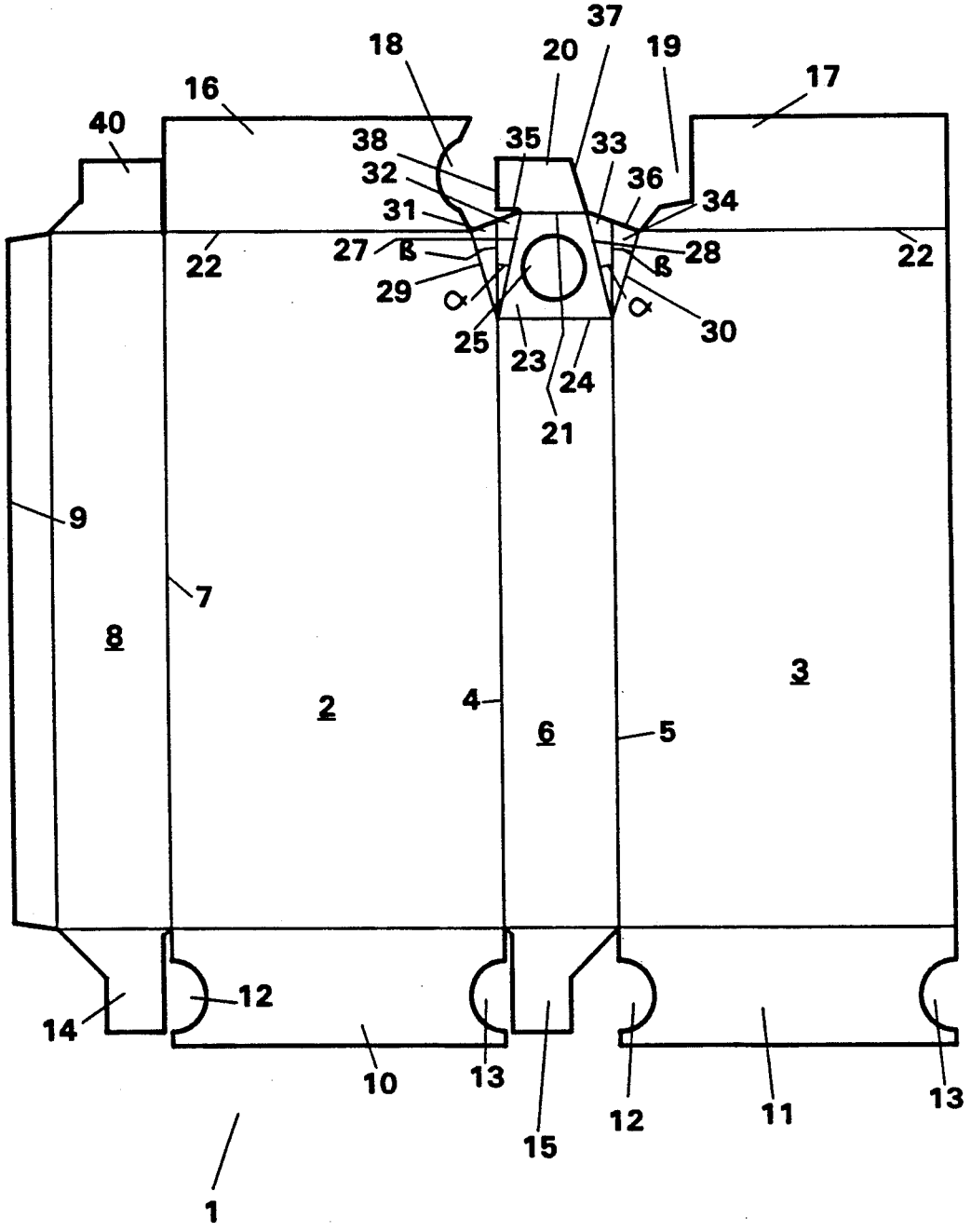
FIG. 1 shows a flat board blank for the production of a pack.

1 in FIG. 1 is a flat board blank which has two side panels 2 and 3 that are connected along folding lines 4 and 5 by an an end panel 6 located between them. A second end panel 8, which is provided with a strip of material 9 that can be connected to the side panel 3 along a longitudinal seam not shown in the drawing—thus forming a pack sleeve—is hinged to the opposite edge of the side panel 2 along a further folding line 7. The two side panels 2 and 3 are each provided on the bottom with a flap 10, 11 that together form the base of the pack. Both flaps 10, 11 are provided at the sides with semi-circular cut-out sections 12, 13, through which tools not shown in the drawing can project when the pack is closed in order to secure an inner bag that is not shown in the drawing either. This inner bag can be produced from a flat film involving the production of a longitudinal seam, while it is also possible to use a section of tubular film for this inner bag. Dust flaps 14 and 15, that are folded in under the flaps 10 and 11 particularly in order to seal off the area of the cut-out sections 12 and 13, are hinged to the bottom end of the two end panels 6, 8. Two lid flaps 16 and 17, which are both provided at the sides facing each other cut-out sections 18, 19, are provided at the top end of the two side panels 2 and 3. A dust flap 20, which is hinged to the end panel 6, is located between these two lid flaps 16 and 17. The hinge line 21 is parallel to the hinge line 22 between the two lid flaps 16, 17 and the side panels but is located slightly higher up, so that the panel 6 is somewhat longer than the adjacent side panels. A top section 23 of this end panel 6 is divided off from the rest of the end panel by a folding line 24 and is provided with a circular opening 25 which serves as a removal opening and in which a screw closure element 26 not shown in this drawing can be inserted. Two slightly curved folding lines 27 and 28 that start at the points where the folding line 24 meets the two folding lines 4 and 5 and end at the two ends of the hinge line 21, forming an angle $\alpha$ in relation to the adjacent folding line 4, 5, extend within the section 23. Two folding lines 29 and 30 extend across the two side panels 2 and 3 at a similar angle $\beta$ to these two folding lines 4, 5. These folding lines 29, 30 also start at the two ends of the folding line 24 and end at the inner end of the hinge line 22 of the two lid flaps 16, 17. The gussets 31, 32 and 33, 34 created between the folding lines, 27, 4, 29 and 28, 5, 30 have a slanting top edge 35, 36 that extends between the hinge lines 21 and 22. One side dust flap 20 runs as an extension to the oblique folding line 28, while the opposite side edge 38 runs as an extension to the straight folding line 4. The other end panel 8 also has a dust flap 40 at the top that is folded in to seal and stabilise the pack.

Figure 2:
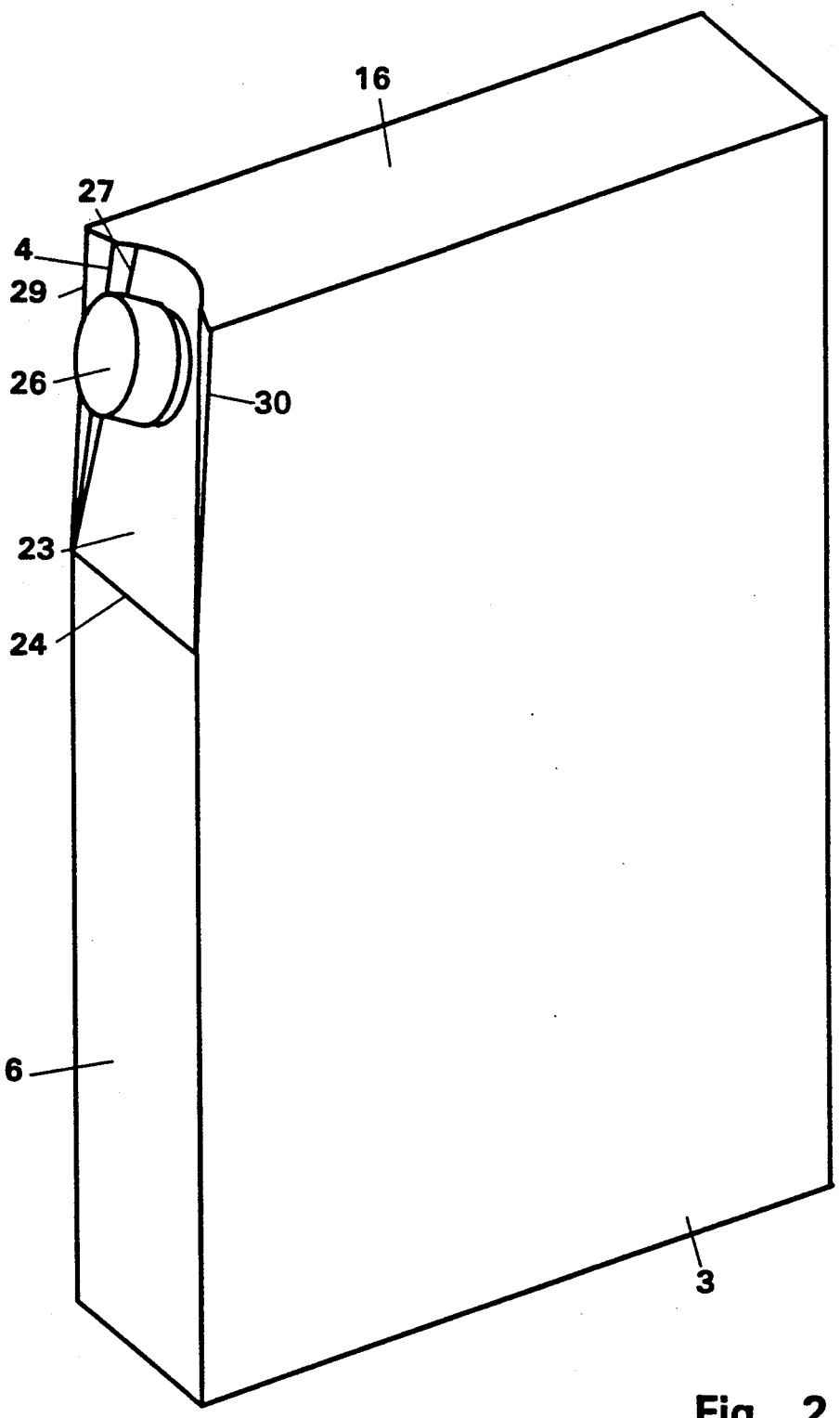
FIG. 2 shows a pack erected from the blank illustrated in FIG. 1.
Figure 3:
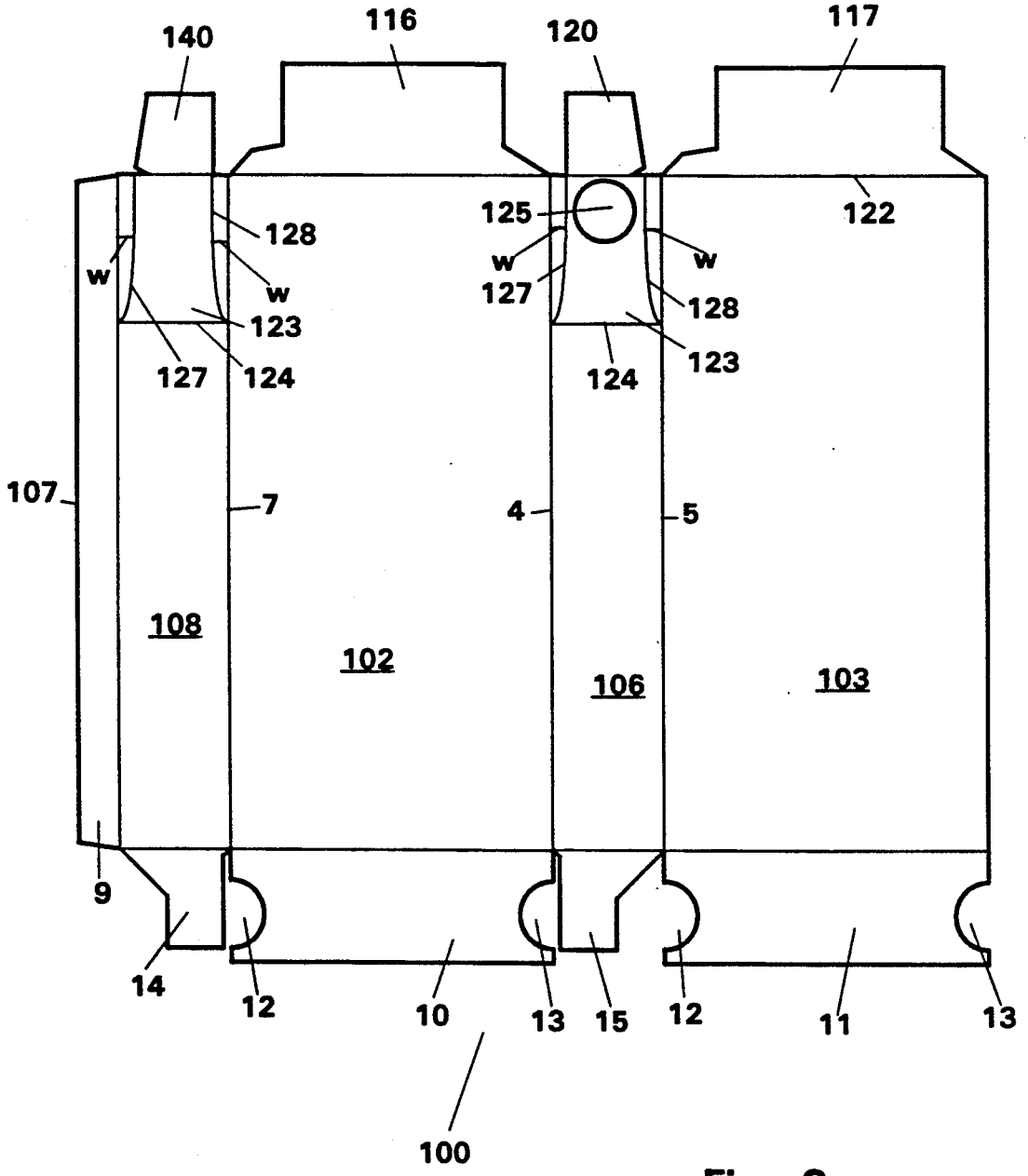
FIG. 3 shows a further flat board blank.

To produce the pack shown in FIG. 2, an inner bag in the form of a sleeve (i.e. open at the top and the bottom)

is first of all attached to the inside of the board blank in a process not illustrated here. The screw closure element 26 is then sealed to the inner bag and then the board blank 1 is sealed along a longitudinal seam (material strip 9, side panel 3) and is erected into a sleeve. Tools can engage the inner bag through the cut-out sections 12, 13, 18, 19 to secure it in place during the rest of the closing operation.

The base is closed in the convention way, i.e. the two dust flaps 14, 15 are folded into place first and then the two base flaps 10, 11 are folded on top. At the lid end the dust flap is folded into place first and then the lid flap 17. The dust flap 20 is then folded inwards and at the same time the top section 23 of the end panel 6 is pushed backwards until the top edge of it rests against the edge of the cut-out section 19 of the lid flap 17. the lid flap 16 then completes the lid closing operation.

In the embodiment shown in FOG. 3 a flat board blank 100 is provided that has the same base design as the first embodiment. Two identical lid flaps 116, 117 are hinged to the two side panels 102 and 103 along a folding line 122, which extends in a straight line across the two end panels 106 and 108 as well, where it acts as a hinge for two dust flaps 120, 140 that are completely identical but opposite ways round. A top section 123, which is itself divided up by two folding lines 127, 128, is divided off from the two end panels 106 and 108 by a folding line 124. These two folding lines 127, 128 extend in a slight curve at an angle w to the adjacent folding line 4,5 and 7, 107 and end at the folding line 122 a distance apart that corresponds to the maximum width of the dust flap 120/140. One of the two sections 123 is provided with an opening 125 in which a screw closure element 26 is sealed.

Figure 4:
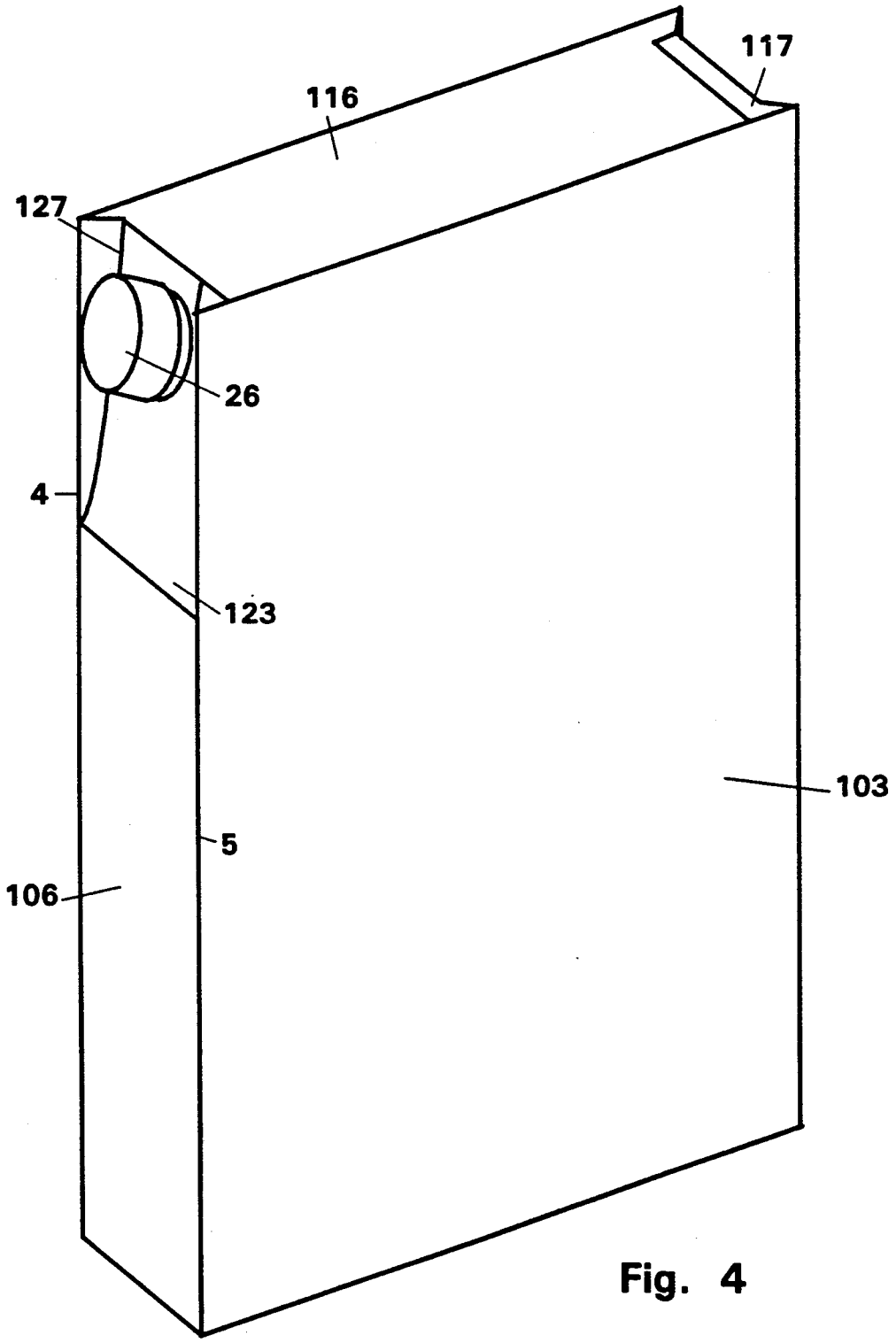
FIG. 4 shows a further pack erected from the blank illustrated in FIG. 3.

The finished pack shown in FIG. 4 also has such a screw closure element 26 and is completely symmetrical apart from this.

Figure 5:
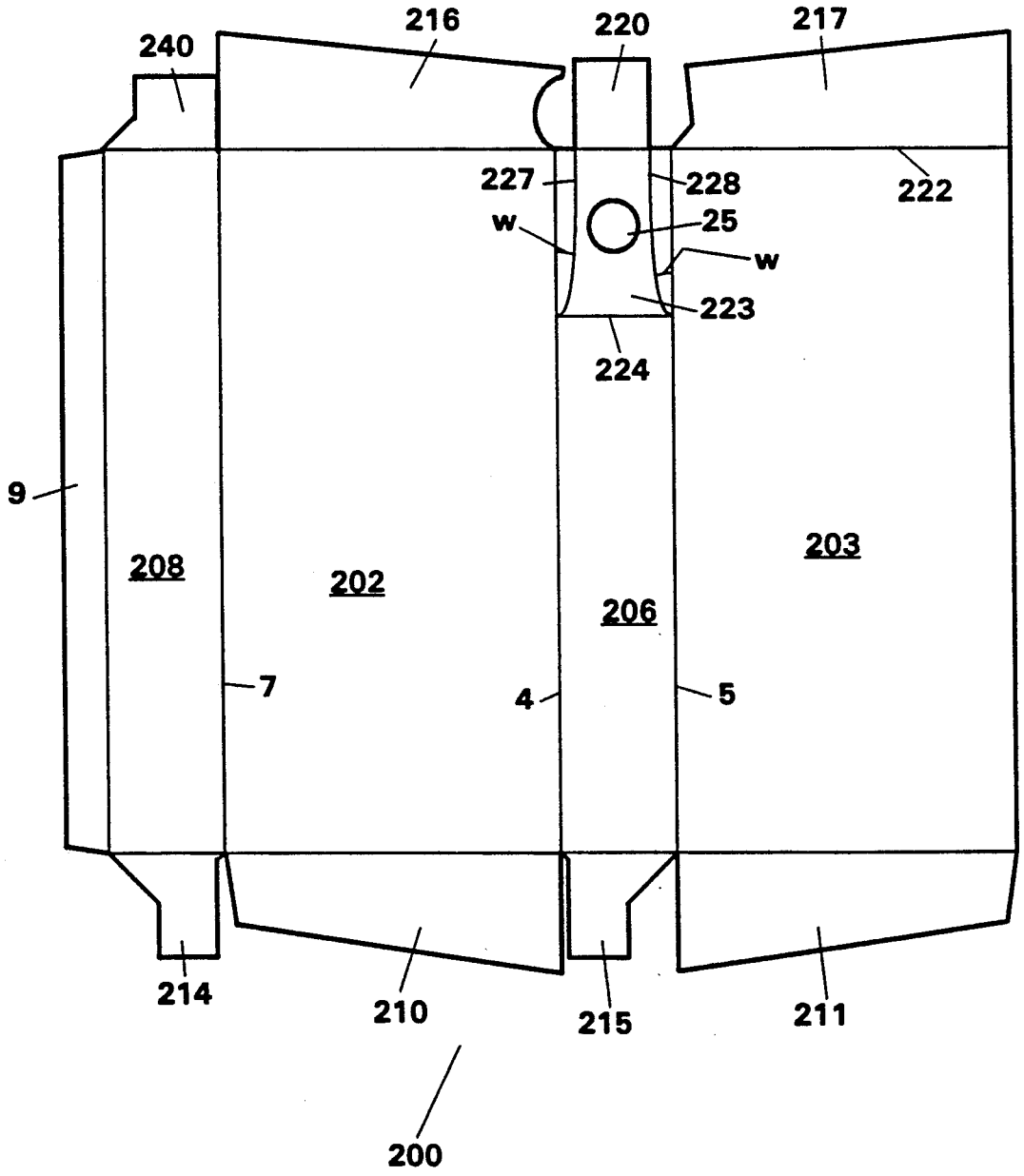
FIG. 5 is a third example of a flat board blank.
Figure 6:
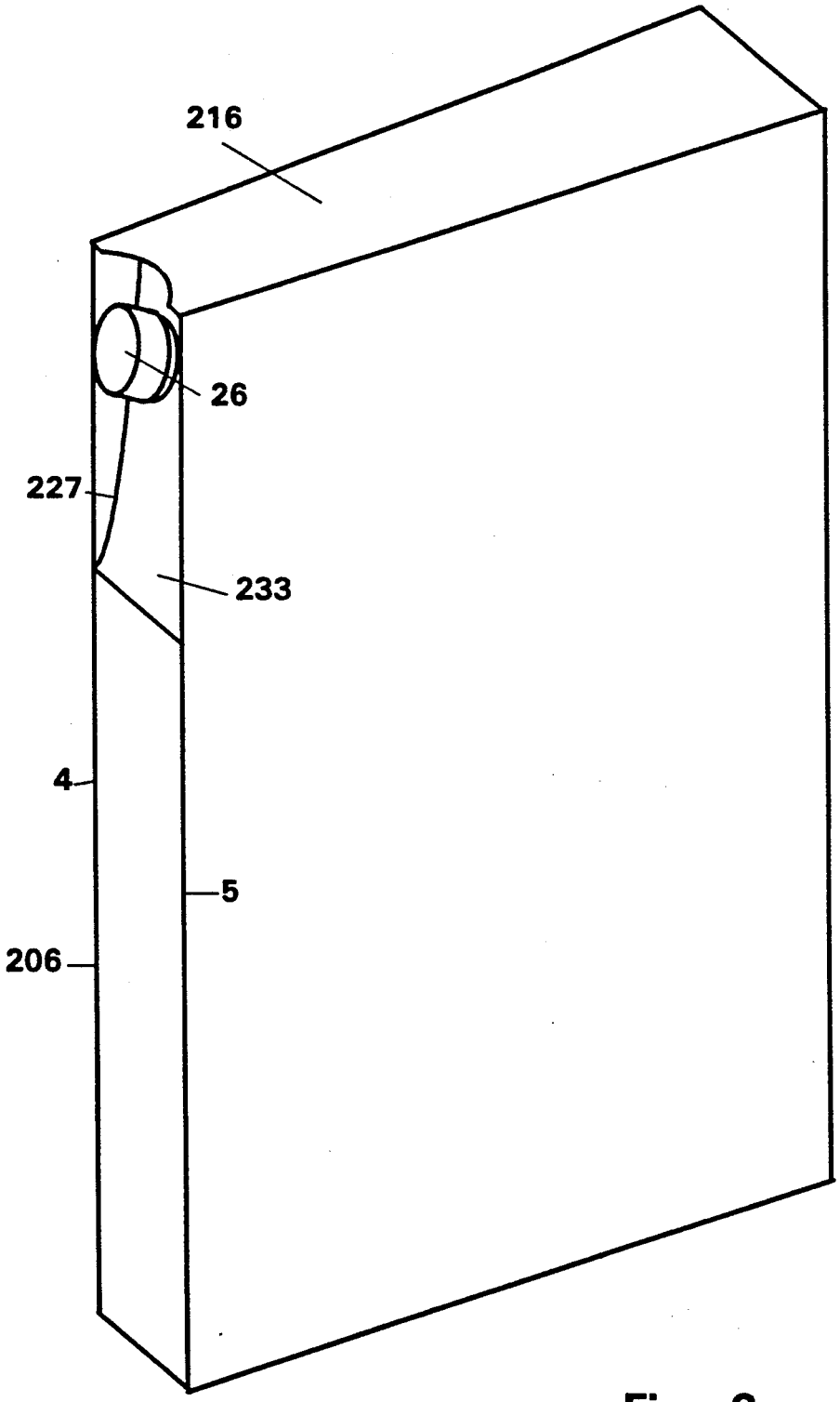
FIG. 6 shows a pack erected from the blank illustrated in FIG. 5.

FIG. 5 shows a flat board blank 200 of a third embodiment, where an oblique lid flap 216, 217 is hinged to the two side panels 202, 203, i.e. these lid flaps and thus the pack shown in FIG. 6 as well taper towards the screw closure element 26 that has been inserted in the opening 25. To enable the board blanks 200 to be produced economically, the base flaps 210 and 211 are designed in such a way that two blanks fit together to a large extent. This does not have any adverse effect on the tightness of the base.

We claim:

1. A pack made from board which pack comprises:

(1) two side panels (2 and 3);

(2) two end panels, one of which end panels (6) which is defined by vertical two folding lines (4 and 5) dividing the end panel from the two side panels (2 and 3);

(3) one base panel attached to each of the two side panels and two end panels; and (4) one lid panel attached to each of the two side panels and two end panels;

wherein one of the lid panels (23) attached to one of the end panels (6) comprises a removal opening (25) and wherein said lid panel (23) comprising the removal opening (25) is divided off from said end panel (6) by a horizontal folding line (24);

wherein two angled folding lines (27, 29; 28, 30) are located at acute angles ($\alpha$ and $\beta$), to each of the two vertical folding lines (4, 5) defining end panel 6, one of said two angled folding lines (27, 28) extending from the part where the two vertical folding lines 4 and 5 meet horizontal folding line 24 to the lid panel comprising the removal opening and the other of said two vertical folding lines (29, 30) extending from the part where the two vertical folding lines 4 and 5 meet horizontal folding line 24 to one of the two respective side panels (2, 3);

wherein one of the lid panels (16, 17) which is attached to a side panel (2, 3) does not extend all the way to the end panel (6) which comprises the removal opening (25);

said one of the two angled folding lines which extend from the end panel into the lid panel (27, 28) being at least slightly curved when they start from horizontal folding line 24;

said lid panel comprising the removal opening being folded back along the two angled folding lines forming acute angles $\alpha$ and $\beta$ to rest against the lid flaps (16, 17) which are attached to the side panels;

wherein in at least the base panels (10, 11) attached to the bottom of the side panels, there are provided cut out sections (12, 13);

wherein the lid panels attached to the side panels are narrower at an end and facing the lid panel (23) comprising the removal opening;

wherein the base panels attached to the side panels are narrower at an end opposite the end the lid panels are narrower at; and wherein a dust flap is hinged to the top end of the top panel comprising the removal opening.

* * * * *